US011654376B2

(12) United States Patent
Rigby et al.

(10) Patent No.: US 11,654,376 B2
(45) Date of Patent: May 23, 2023

(54) COUNT AND SLIDE RING CHUTE

(71) Applicant: Lovevery, Inc., Boise, ID (US)

(72) Inventors: Thomas Creason Rigby, Boise, ID (US); Philip Jacob Fouts, Boise, ID (US); Amanda McKown O'Grady, Boise, ID (US)

(73) Assignee: Lovevery, Inc., Boise, ID (US)

( * ) Notice: Subject to any disclaimer, the term of this patent is extended or adjusted under 35 U.S.C. 154(b) by 0 days.

(21) Appl. No.: 17/347,592

(22) Filed: Jun. 15, 2021

(65) Prior Publication Data

US 2022/0395762 A1 Dec. 15, 2022

(51) Int. Cl.
*A63H 33/00* (2006.01)

(52) U.S. Cl.
CPC ..... *A63H 33/00* (2013.01)

(58) Field of Classification Search
CPC .... A63H 33/00; A63H 7/02; A63H 15/00–02; A47F 1/087
USPC ..... 446/168–174, 85–128, 396, 431–466; 434/208
See application file for complete search history.

(56) References Cited

U.S. PATENT DOCUMENTS 1,279,270 A * 9/1918 Cole ..... A63F 7/3622 446/168
1,383,316 A * 7/1921 Liebert ..... A63F 9/14 446/168
1,739,719 A * 12/1929 Gunderman ..... A63F 7/3622 273/120 R
2,391,529 A * 12/1945 Walker ..... A63F 7/3622 446/173
2,530,898 A * 11/1950 Morrison ..... A63H 33/00 446/168
2,571,521 A * 10/1951 Barnhart ..... A63F 7/02 273/120 R
2,609,637 A * 9/1952 Spence ..... A63H 33/00 124/79
2,686,386 A * 8/1954 Booth ..... A63B 67/08 446/168
2,729,020 A * 1/1956 Frampton ..... A63F 7/04 273/153 R
2,749,656 A 6/1956 Reynolds
2,852,327 A * 9/1958 Mason ..... A47F 1/087 D7/703
2,923,122 A * 2/1960 Inman ..... G04B 25/005 446/168
2,931,131 A * 4/1960 Morse ..... A63F 7/3622 446/168
2,996,344 A 8/1961 Garman
3,190,656 A * 6/1965 Weisbecker ..... A63H 33/00 273/138.4

(Continued)

*Primary Examiner* — Eugene L Kim
*Assistant Examiner* — Matthew B Stanczak
(74) *Attorney, Agent, or Firm* — Fish & Richardson P.C.

(57) ABSTRACT

A toddler toy includes a box including one or more internal horizontal shelves extending to different depths from one or more corresponding openings at a front end of the box, and a chute positioned below the one or more internal horizontal shelves, the chute configured to return one or more objects falling from distal ends of the one or more internal horizontal shelves, in response to an additional object pushed onto the one or more internal horizontal shelves through the one or more corresponding openings, to a retrieval opening at the front end of the box.

19 Claims, 6 Drawing Sheets

(56) References Cited

U.S. PATENT DOCUMENTS 3,192,663 A * 7/1965 Kirschner ..... A63H 15/00 473/569
3,318,455 A * 5/1967 Takahashi ..... A47F 1/087 312/45
3,406,971 A * 10/1968 Koff ..... A63F 7/042 273/153 R
3,514,894 A 6/1970 Novak
3,561,757 A * 2/1971 Schillig ..... A63B 9/00 446/104
3,653,146 A * 4/1972 Goldfarb ..... A63H 17/44 446/423
3,690,018 A * 9/1972 Arroyo ..... G09B 19/02 434/200
3,784,022 A 1/1974 Beesley
3,949,516 A * 4/1976 Gronert ..... A63H 17/44 446/423
3,994,076 A * 11/1976 Bertman ..... G09B 23/02 446/124
4,398,638 A * 8/1983 Racine ..... A47F 7/17 211/85.5
4,553,749 A * 11/1985 Bender ..... A63F 7/3622 273/459
4,676,074 A * 6/1987 Morgan, Jr. ..... G07F 9/105 62/277
4,781,643 A 11/1988 Holloway et al.
4,929,216 A * 5/1990 Morris ..... A63H 7/04 473/588
5,056,789 A * 10/1991 Talbot ..... A63F 7/3622 273/153 R
5,122,093 A * 6/1992 Perkitny ..... G07D 3/04 453/13
5,356,033 A * 10/1994 Delaney ..... A47F 1/087 221/277
5,368,191 A * 11/1994 Johnson ..... B65D 83/08 312/42
5,368,514 A * 11/1994 Glickman ..... A63H 19/30 446/120
5,421,762 A * 6/1995 Glickman ..... A63H 33/26 446/124
5,451,178 A * 9/1995 Yorozu ..... G09B 5/04 446/175
5,575,702 A * 11/1996 Silvious ..... A63H 15/08 446/431
5,794,817 A * 8/1998 Rosa ..... A47F 1/08 211/49.1
6,173,582 B1 * 1/2001 Hixson ..... F25D 25/00 62/457.4
6,340,323 B1 * 1/2002 Glynn ..... A63H 33/042 40/406
D474,042 S * 5/2003 Chang ..... D6/515
7,037,171 B2 5/2006 Clark et al.
7,690,518 B2 * 4/2010 Fincher ..... A47F 1/12 211/59.2
7,913,860 B2 * 3/2011 Meri ..... G07F 11/32 211/59.2
7,931,520 B2 * 4/2011 Bryce ..... A63H 17/262 446/431
8,028,855 B2 10/2011 White et al.
8,241,084 B2 * 8/2012 Todokoro ..... G09B 5/04 446/175
8,628,003 B2 * 1/2014 Thomas ..... B65D 83/00 206/427
8,757,433 B2 * 6/2014 Machers ..... G07F 11/34 221/202
8,985,346 B2 * 3/2015 Bogdziewicz ..... G07F 11/30 211/59.2
9,320,365 B2 * 4/2016 Fortuna ..... A47F 1/087
9,591,933 B2 * 3/2017 Burke ..... A47F 3/14
2004/0082258 A1 * 4/2004 Kim ..... A63H 18/02 446/85
2005/0095948 A1 * 5/2005 Snyder ..... A63H 33/006 446/175
2005/0183929 A1 8/2005 Low et al.
2008/0067188 A1 * 3/2008 White ..... G07F 11/10 221/123
2010/0124866 A1 * 5/2010 Todokoro ..... G09B 5/04 446/168
2010/0197196 A1 * 8/2010 Bryce ..... A63H 17/262 446/431
2012/0064798 A1 * 3/2012 Smokowski ..... A63H 18/028 446/444
2014/0011425 A1 * 1/2014 Christopherson .... A63H 33/006 446/227
2021/0106923 A1 * 4/2021 Catz ..... A63H 33/00

* cited by examiner

COUNT AND SLIDE RING CHUTE

TECHNICAL FIELD

This disclosure relates to toys and more particularly to infant and toddler toys.

BACKGROUND

Children begin to learn to use their vision to follow the movement of objects in motion at the infant and toddler stage. Infants and toddlers can benefit from playing with toys to help with the development of visual memory and visual perception. Such toys can be designed to facilitate development of the children's fine motor skills, to assist with their understanding of object permanence, and to facilitate development of cause-and-effect thinking skills. Improvements in the design, configuration, and safety of such toys and their components are continually sought.

SUMMARY

In general, this disclosure relates to toys that include one or more shelves, a chute, and one or more objects that are configured to be inserted into the toy and to slide on the chute.

In one aspect, this disclosure relates to a toddler toy including a box including one or more internal horizontal shelves extending to different depths from one or more corresponding openings at a front end of the box; and a chute positioned below the one or more internal horizontal shelves, the chute configured to return one or more objects falling from distal ends of the one or more internal horizontal shelves, in response to an additional object pushed onto the one or more internal horizontal shelves through the one or more corresponding openings, to a retrieval opening at the front end of the box.

In some embodiments, a back wall of the box defines a rear opening sized to receive the one or more objects.

In some embodiments, the chute includes a distal end coupled to the back wall, below the rear opening, and a proximal end at the front end of the box.

In some embodiments, the rear opening is directly aligned with a corresponding opening of the one or more corresponding openings.

In some embodiments, the box includes one or more windows.

In some embodiments, a window from the one or more windows is a transparent panel positioned above the one or more internal horizontal shelves.

In some embodiments, the one or more windows are aligned with the one or more shelves.

In some embodiments, the one or more objects and the additional object include rings.

In some embodiments, the rings have a height that is at least about 50% of a height of the openings at the front end of the box.

In some embodiments, the one or more objects and the additional object include blocks.

In some embodiments, the one or more objects and the additional object are configured to slide on a surface of the chute.

In some embodiments, the one or more objects and the additional object include disks.

In some embodiments, the disks are wheels attached to the blocks.

In some embodiments, the one or more objects and the additional object are configured to roll on a surface of the chute.

In some embodiments, the front end of the box is open.

In some embodiments, the chute has a curved surface.

In some embodiments, the chute has a planar surface.

In some embodiments, the chute extends downwardly towards the retrieval opening.

In another aspect, the present disclosure features a toddler toy including a box including a first internal horizontal shelf, a second internal horizontal shelf, and a third internal horizontal shelf, the first, second, and third internal horizontal shelves extending to different depths from corresponding openings at a front end of the box; and a chute positioned below the first, second, and third internal horizontal shelves, the chute configured to return one or more objects falling from distal ends of the shelves, in response to an additional object pushed onto the shelf through the corresponding opening, to a retrieval opening at the front end of the box, wherein the chute has a curved surface extending downwardly towards the retrieval opening, and wherein a side wall of the box defines a first window, a second window, and a third window, the first, second, and third windows having a length that is about equal to a corresponding length of each of the first, second, and third internal horizontal shelves.

In another aspect, the present disclosure features a toddler toy including a box including a first internal horizontal shelf, a second internal horizontal shelf, and a third internal horizontal shelf, the first, second, and third internal horizontal shelves extending to different depths from corresponding openings at a front end of the box; and a chute positioned below the first, second, and third internal horizontal shelves, the chute configured to return one or more objects falling from distal ends of the shelves, in response to an additional object pushed onto the shelf through the corresponding opening, to a retrieval opening at the front end of the box, wherein the chute has a planar surface extending downwardly towards the retrieval opening, and wherein the box includes a transparent panel positioned above the first, second, and third internal horizontal shelves.

In some embodiments, the rear opening is positioned above the chute.

In some embodiments, the rear opening is positioned above the one or more shelves. In some embodiments, the rear opening is directly opposed to a corresponding opening of the one or more corresponding openings.

In some embodiments, a side wall of the box defines one or more windows.

In some embodiments, the box includes a first shelf, a second shelf, and a third shelf extending to corresponding first, second, and third depths from the corresponding openings at the front end of the box.

In some embodiments, the first shelf extends to a first depth that is greater than the second and third depths.

In some embodiments, the second shelf extends to a second depth that is greater than the third depth.

In some embodiments, the first, second, and third shelves have different lengths.

In some embodiments, the corresponding openings are sized to receive the one or more objects.

In some embodiments, the corresponding openings are sized to receive one object, of the one or more objects, at a time.

In some embodiments, the rear opening is sized to receive an object from the one or more objects, at a time.

In some embodiments, the one or more windows have a rounded rectangular shape having a length that is about equal to the length of the one or more internal horizontal shelves.

Embodiments may provide one or more of the following advantages.

Various embodiments of the present disclosure relate to toys preferably intended for use by toddlers and/or infants of age three and under. The toys of the disclosure are therefore designed to be approved for use by children under three years of age e.g., in the United States and European Union (per the 16 Code of Federal Regulations (C.F.R.) Part 1501 and The Toy Safety Directive 2009/48/EC, respectively). For example, the toys do not have sharp edges and points that could present a hazard to the user. In another example, the toys meet hazardous substance requirements.

In some embodiments, the toys include one or more windows or panels that provide a user (e.g., an infant and/or toddler) with visual confirmation of the movement of the objects as they are loaded onto shelves and pushed off onto the chute. The windows or panels of the toy can further facilitate development of visual perception and of the infant and/or toddler and assist with their understanding of object permanence by allowing the user to observe the movement of the object.

In some embodiments, the toys provide a user with three horizontal shelves of varying lengths that are configured to hold a varying number of objects (e.g., rings) that the user can push off onto the chute. For example, a first horizontal shelf has a first length that can hold one object, a second shelf has a second horizontal length that can hold two objects, and a third shelf has a third horizontal length that can hold three objects. The varying lengths of the toy can facilitate development of cause-and-effect thinking skills of the infant and/or toddler by allowing the user to learn each shelf holds a different number of objects.

In some embodiments, the toys include one or more openings that provide the user access to the horizontal shelves. The one or more openings are designed to have a width that is less than a width of two contiguous rings. For example, the user is unable to simultaneously introduce two rings into the one or more openings. Such design ensures the one or more openings fit only one ring at a time and, by doing so, the design facilitates the development of the fine motor skills of the infant and/or toddler.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
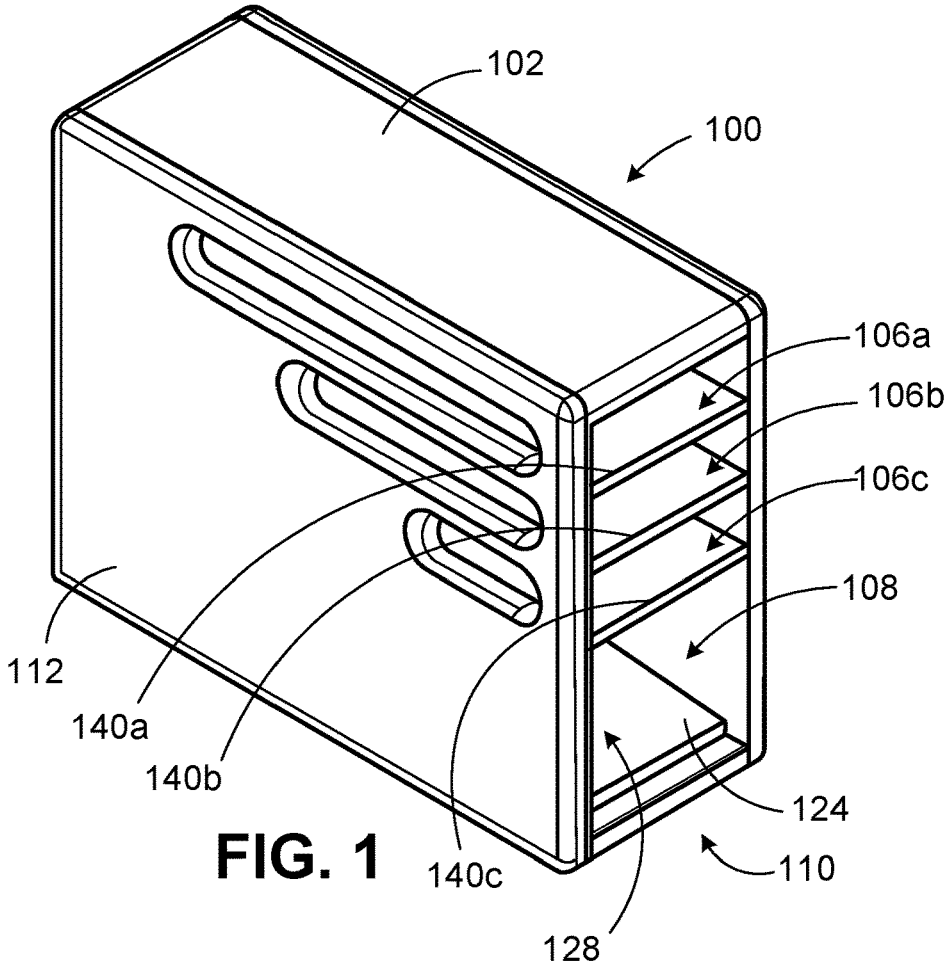
FIG. 1 is a perspective view of a toy.

FIG. 1 illustrates a toy 100 that can be used by a toddler and/or infant (e.g., under three years of age) for play and/or educational purposes. The toy 100 includes a box 102 defining an interior space 128 that includes a first internal horizontal shelf 104*a*, a second internal horizontal shelf 104*b*, a third internal horizontal shelf 104*c*, and a chute 124. The toy 100 can further include one or more objects (e.g., one or more rings), which are inserted into the box 102 by the user such that the objects are held by the first, second, and/or third internal horizontal shelves 104*a*, 104*b*, 104*c* and/or slide on the chute 124. The toy 100 is typically made of one or more rigid materials that can withstand foreseeable use and/or damage by children. Example materials from which the toy 100 may be made include wood (e.g., birch plywood).

Figure 2:
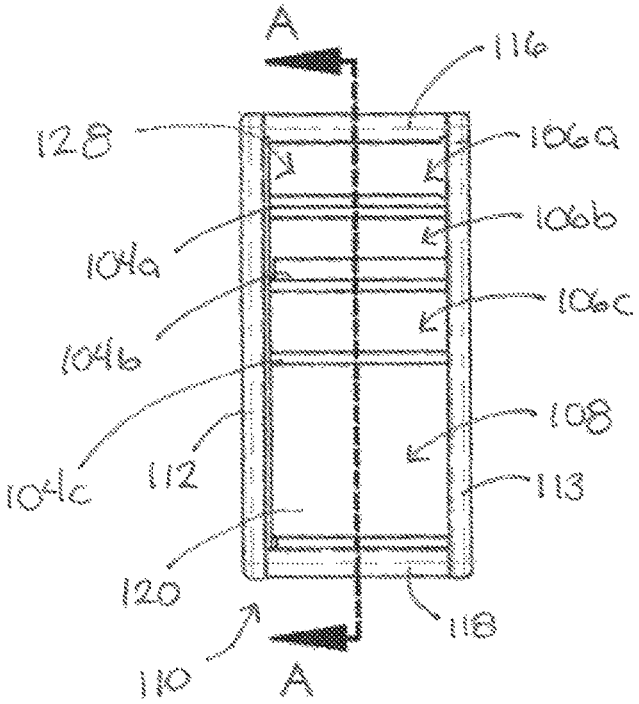
FIG. 2 is a front view of the toy of FIG. 1.

Referring to FIG. 2, the box 102 includes a pair of side walls 112, 113 that are integrally connected with a top wall 116, a bottom wall 118, and a back wall 120 to form a rectangular prism shape. The box 102 is open-ended and has a front end 110 that is open. The front end 110 can provide a user access to the interior space 128 of the box 102. The first, second, and third internal horizontal shelves 104*a*, 104*b*, 104*c* have different lengths and extend from different openings at the front end 110 to different depths within the interior space 128 of the box 102. For example, the first internal horizontal shelf 104*a* extends from a first opening 106*a* to a first depth of the box 102. The second internal horizontal shelf 104*b* extends from a second opening 106*b* to a second depth of the box 102. The third internal horizontal shelf 104*c* extends from a third opening 106*c* to a third depth of the box 102. The first, second, and third internal horizontal shelves 104*a*, 104*b*, 104*c* are arranged such that the first internal horizontal shelf 104*a* is positioned above the second internal horizontal shelf 104*b*, and the second internal horizontal shelf 104*b* is positioned above the third internal horizontal shelf 104*c*. In this manner, the third internal horizontal shelf 104*c* and the bottom wall 118 define a retrieval opening 108 that provides a user access to retrieve one or more objects that may be slid on the chute. The first, second, and third openings 106*a*, 106*b*, 106*c* are sized to receive one or more objects (e.g., rings) to be slid on the chute 124.

The first, second, and third internal horizontal shelves 104*a*, 104*b*, 104*c* typically have a width of about 76 millimeters (mm) to about 86 mm (e.g., about 81 mm). The first, second, and third openings 106*a*, 106*b*, 106*c* typically have a width of about 76 mm to about 86 mm (e.g., about 81 mm). Thus, the first, second, and third internal horizontal shelves 104*a*, 104*b*, 104*c* typically have a width that is about equivalent to the width of the first, second, and third openings 106*a*, 106*b*, 106*c*. The first, second, and third internal horizontal shelves 104*a*, 104*b*, 104*c* typically have a width that is greater than a width of an object (e.g., a ring) inserted through the first, second, and/or third openings 106*a*, 106*b*, 106*c*. The first, second, and third internal horizontal shelves 104*a*, 104*b*, 104*c* typically have a width that is less than a width of two contiguous objects (e.g., two contiguous rings), configured to be used inserted through the first, second, and/or third openings 106*a*, 106*b*, 106*c*. The first, second, and third openings 106*a*, 106*b*, 106*c* typically have a width that is greater than a width of an object (e.g., a ring) inserted through the first, second, and/or third openings 106*a*, 106*b*, 106*c*. The first, second, and third openings 106*a*, 106*b*, 106*c* typically have a width that is less than a width of two contiguous objects (e.g., two contiguous rings) that are configured to be used inserted through the first, second, and/or third openings 106*a*, 106*b*, 106*c*.

Figure 3:
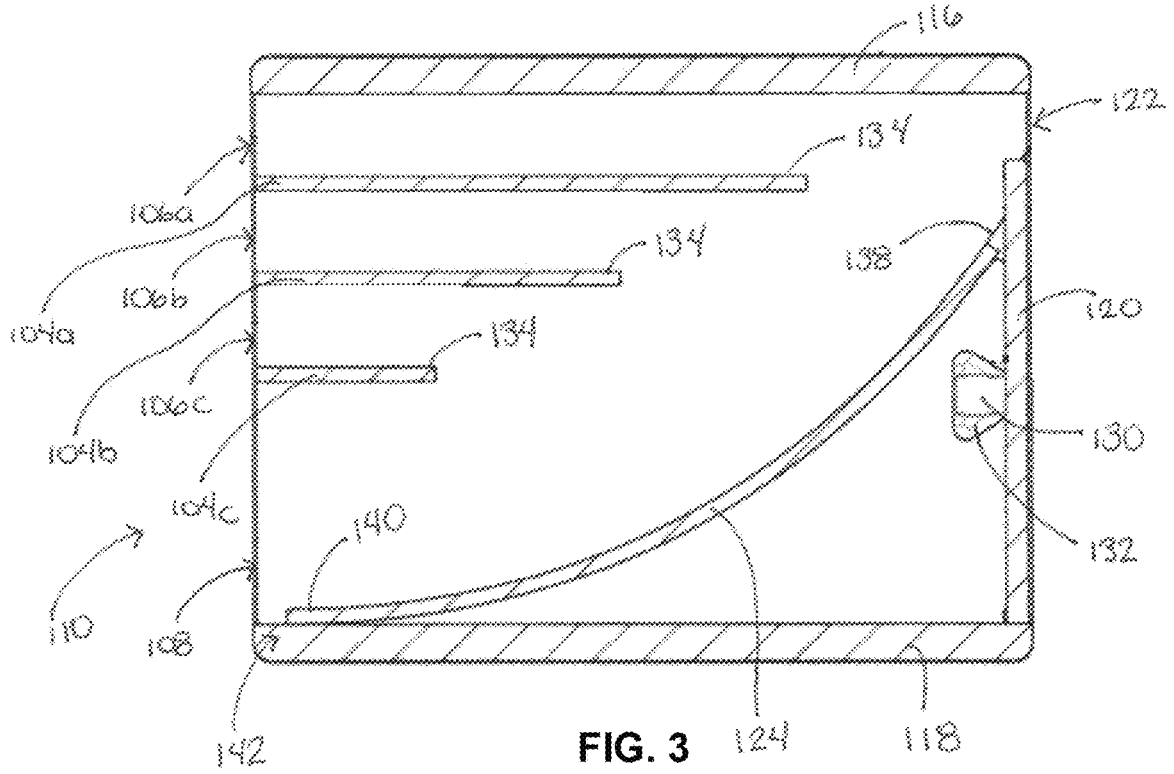
FIG. 3 is a cross-sectional view of the toy taken along the line A-A of FIG. 2.

FIG. 3 illustrates a cross-sectional view of FIG. 2 through line A-A. The first, second, and third internal horizontal shelves 104*a*, 104*b*, 104*c* are secured to the side walls of the box in decreasing order according to their length. In some embodiments, the first, second, and third internal horizontal shelves 104*a*, 104*b*, 104*c* can be secured to the side walls via an adhesive (e.g., polyvinyl acetate (PVA) adhesive, polyurethane adhesive, or the like) or a fastener (e.g., a screw). In another example, the side walls 112, 113 can define slots configured to receive the first, second, and third internal horizontal shelves 104*a*, 104*b*, 104*c*.

The first internal horizontal shelf 104*a* has a first length that is greater than the lengths of the second internal horizontal shelf 104*b* and the third internal horizontal shelf 104*c*. The second internal horizontal shelf 104*b* has a second length that is less than the length of the first internal horizontal shelf 104*a* and that is greater than the third internal horizontal shelf 104*c*. The third internal horizontal shelf 104*c* has a third length that is less than the length of the first and second internal horizontal shelves 104*a*, 104*b*. Similarly, the first internal horizontal shelf 104*a* extends to a first depth, within the interior space 128 of the box 102, that is greater than the second and third depths. The second internal horizontal shelf 104*a* extends to a second depth that is greater than the third depth and less than the first depth. The third internal horizontal shelf 104*c* extends to a third depth that is less than the first and second depths.

The first internal horizontal shelf 104*a* typically has a length of about 138 mm to about 158 mm (e.g., about 148 mm). The second internal horizontal shelf 104*b* typically has a length of about 88 mm to about 108 mm (e.g., about 98 mm). The third internal horizontal shelf 104*c* typically has a length of about 38 mm to about 58 mm (e.g., about 48 mm). The first, second, and third internal horizontal shelves 104*a*, 104*b*, 104*c* typically have a thickness of about 1 mm to about 10 mm (e.g., about 4 mm).

The first, second, and third internal horizontal shelves 104*a*, 104*b*, 104*c* are spaced out substantially equidistantly from each other such that the first, second, and third openings have about the same height. The first, second, and third openings 106*a*, 106*b*, 106*c* typically have a height that is less than a height of two stacked objects (e.g., two rings stacked vertically on top of each other) that are configured to be used inserted through any of the first, second, and third openings 106*a*, 106*b*, 106*c*. The first, second, and third openings 106*a*, 106*b*, 106*c* typically have a height that is about half of the length of the third internal horizontal shelf 104*c*. The first, second, and third openings 106*a*, 106*b*, 106*c* typically have a height of about 12 mm to about 32 mm (e.g., about 22 mm).

The toy 100 includes a chute 124 extending downwardly from a distal end 138 to a proximal end 140 near the retrieval opening 108. The distal end 138 of the chute 124 is secured to the back wall 120 and the proximal end 140 of the chute 124 is secured to a proximal end 142 of the bottom wall 118 near the front end 110 of the box. The distal end 138 of the chute 124 is secured to the back wall 120 at an attachment point that is aligned with the second opening 106*b*. The back wall 120 of the box defines a rear opening 122 that is sized to receive the one or more objects (e.g., rings). The rear opening 122 is directly aligned with the first opening 106*a*. The distal end 138 of the chute 124 is secured to a portion of the back wall 120 that is below the rear opening 122. The chute 124 is secured to the box via a fastener 130 (e.g., a screw). The back wall 120 further includes an insert 132 receiving the fastener 130. The insert 132 can be made out of any suitable material (e.g., plastic). The chute 124 is positioned below the first, second, and third internal horizontal shelves 104*a*, 104*b*, 104*c* and is configured to return one or more objects (e.g., rings) falling from a distal end 134 of the first, second, and/or third internal horizontal shelves 104*a*, 104*b*, 104*c*. The one or more objects (e.g., rings) can fall in response to an additional object being pushed onto the shelf holding the objects after being inserted through the first, second, and/or third openings 106*a*, 106*b*, 106*c*. Once the object falls from a distal end 134, it lands on a curved surface 136 of the chute 124 and rolls to the retrieval opening 108 at the front end 110 of the box.

When in use, the user (e.g., a toddler and/or infant) inserts a first object through one of the first, second, or third openings 106*a*, 106*b*, 106*c* and onto a corresponding shelf of the first, second, or third internal horizontal shelves 104*a*, 104*b*, 104*c*. The user subsequently inserts a second object through the same opening and pushes the first object resting on the shelf in order to cause the first object to fall off of the distal end 134 of the shelf and onto the curved surface 136 of the chute 124. If the first object does not fall off of the distal end 134 of the shelf after the second object is inserted, the step is repeated (e.g., a third, fourth, or more objects are inserted to push the first object onto the chute 124). The user can also insert an object through the rear opening 122 such that the object reaches the curved surface 136 of the chute 124 without the need to use a second object to push it onto the chute 124. Once the object contacts the curved surface 136 of the chute 124, the object slides downwardly on the chute 124 until it reaches the retrieval opening 108 where the user can access the object.

The chute 124 is typically made of one or more rigid materials that can have a substantially smooth surface on which the one or more objects (e.g., rings) can slide on. Example materials from which the chute 124 may be made include wood (e.g., birch plywood).

Figure 4:
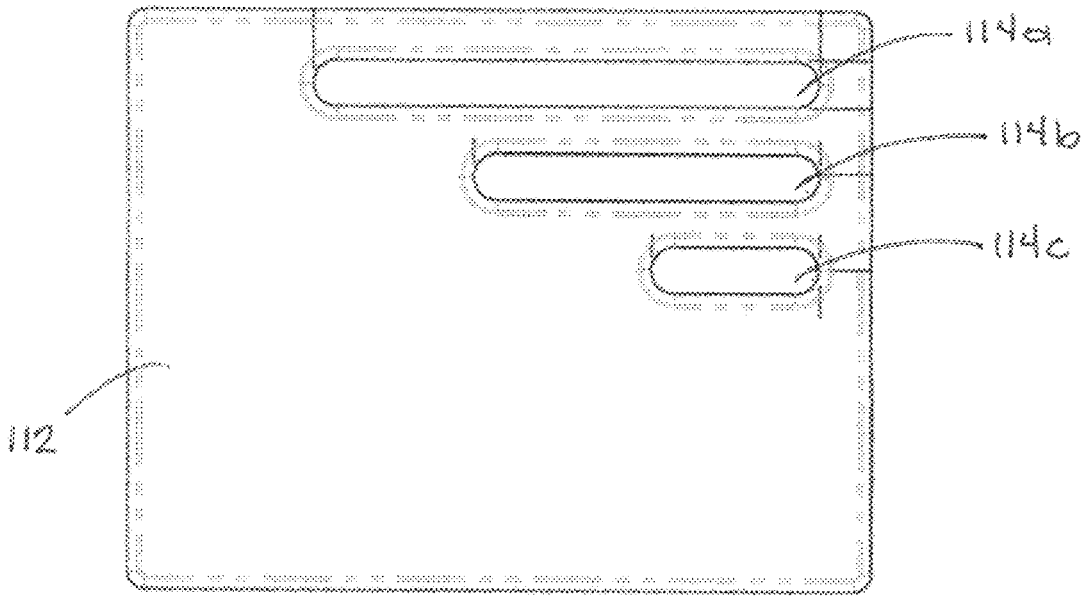
FIG. 4 is a side view of the toy of FIG. 1.

Referring to FIG. 4, the side wall 112 is provided as a rectangular side wall having a length that is greater than a height of the box. The side wall 112 and side wall 113 (shown in FIG. 2) typically have equivalent heights and have rounded corners to prevent any potential hazard to the user and to comply with toy safety requirements. The length of the side wall 112 typically has a length of about 199 mm to about 219 mm (e.g., about 209 mm). The height of the box (i.e., the height of side wall 112) typically has a height of about 154 mm to about 174 mm (e.g., about 154 mm).

The side wall 112 further defines a first window 114*a*, a second window 114*b*, and a third window 114*c* that are aligned with first, second, and/or third internal horizontal shelves 104*a*, 104*b*, 104*c*. In other words, the first, second, and third windows 114*a*, 114*b*, 114*c* allow a user to observe the one or more objects as they are placed and/or pushed along on the first, second, and/or third internal horizontal shelves 104*a*, 104*b*, 104*c* to cause an additional object to slide down the chute 124. The first, second, and third windows 114*a*, 114*b*, 114*c* are typically made of a transparent material (e.g., a transparent plastic). The first, second, and third windows 114*a*, 114*b*, 114*c* are shaped as rounded rectangles (e.g., a rectangle with rounded corners) with varying lengths corresponding to the lengths of the first, second, and third internal horizontal shelves 104*a*, 104*b*,

104*c*. For example, the first window 114*a* has a length that is about equal to the length of the first internal horizontal shelf 104*a*, the second window 114*b* has a length that is about equal to the length of the second internal horizontal shelf 104*b*, and the third window 114*c* has a length that is about equal to the length of the third internal horizontal shelf 104*c*.

The first window 114*a* typically has a length of about 132 mm to about 152 mm (e.g., about 142 mm). The second window 114*b* typically has a length of about 87 mm to about 107 mm (e.g., about 97 mm). The third window 114*c* typically has a length of about 37 mm to about 57 mm (e.g., about 47 mm). The first, second, and third windows 114*a*, 114*b*, 114*c* typically have a height of about 3 mm to about 23 mm (e.g., about 13 mm).

Figure 5:
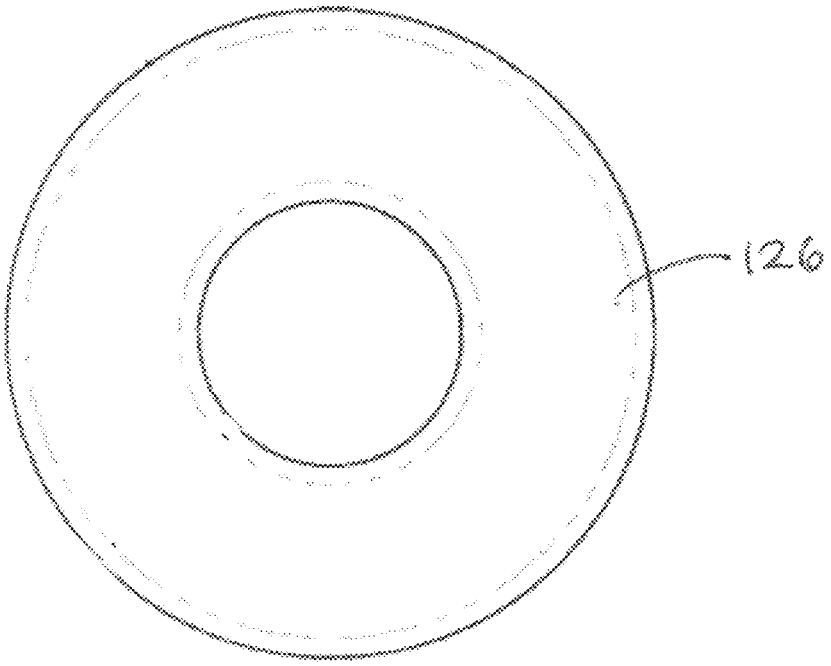
FIG. 5 is a top view of a ring.
Figure 6:
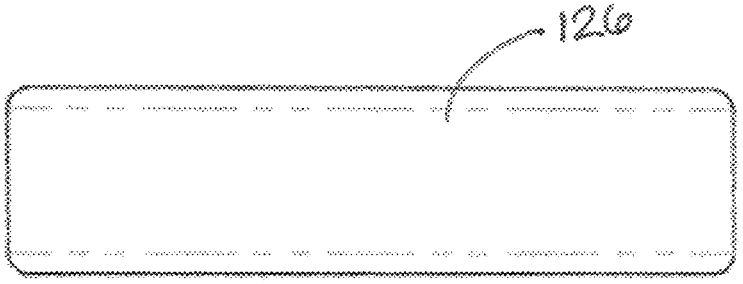
FIG. 6 is a side view of the ring of FIG. 5.
Figure 8:
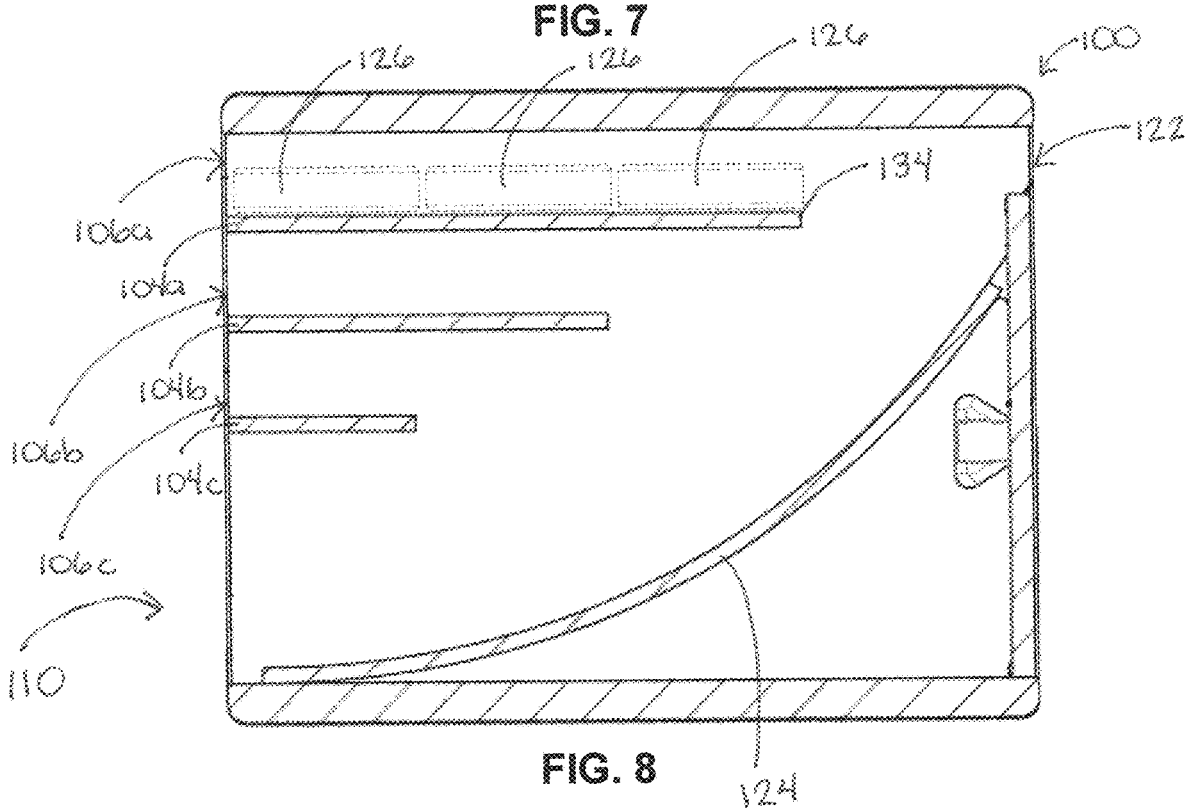
FIG. 8 is a partial, cross-sectional view of the toy taken along the line A-A of FIG. 2 and further including three rings.

FIGS. 5 and 6 illustrate top and side views, respectively, of a ring 126 that is configured to be used with toy 100 (shown in FIG. 1). The toy 100 (shown in FIG. 1) includes four rings 126. The first internal horizontal shelf 104*a* can hold three contiguous rings 126, as shown in FIG. 8. The ring 126 typically has an inner diameter that is 10 mm to about 30 mm. The ring 126 typically has an inner diameter that is 40 mm to about 60 mm (e.g., about 50 mm). The ring 126 typically has a height that is 3 mm to about 23 mm (e.g., about 10 mm). The ring 126 is typically made of one or more rigid materials that can withstand foreseeable use and/or damage by children. Example materials from which the ring 126 may be made include wood (e.g., birch plywood).

Figure 7:
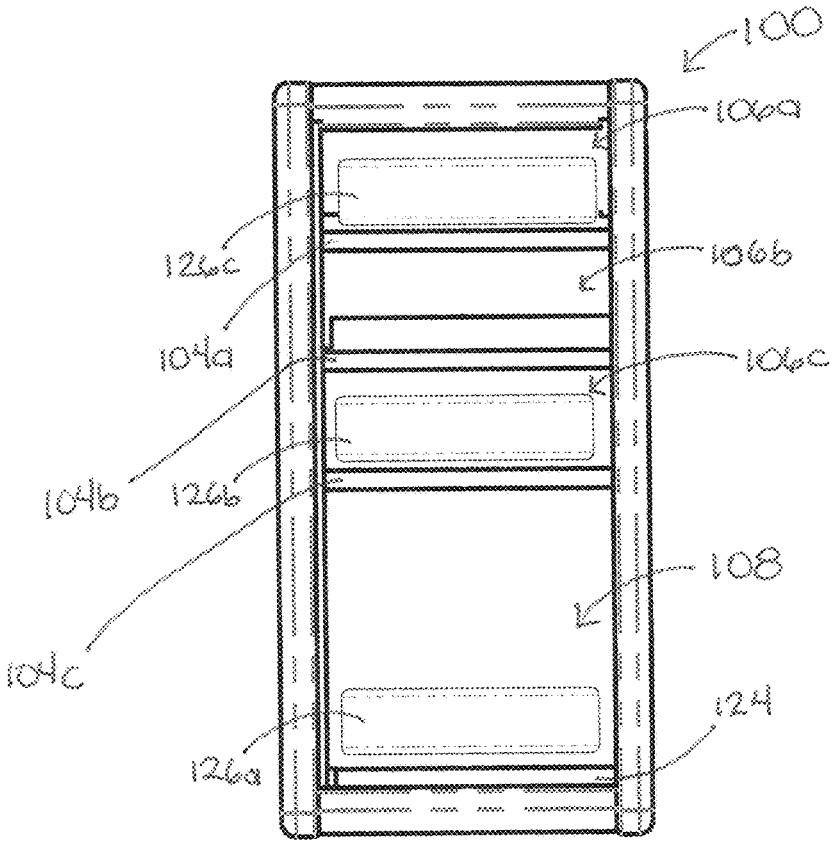
FIG. 7 is a front view of the toy of FIG. 1 including three or more rings.
Figure 9:
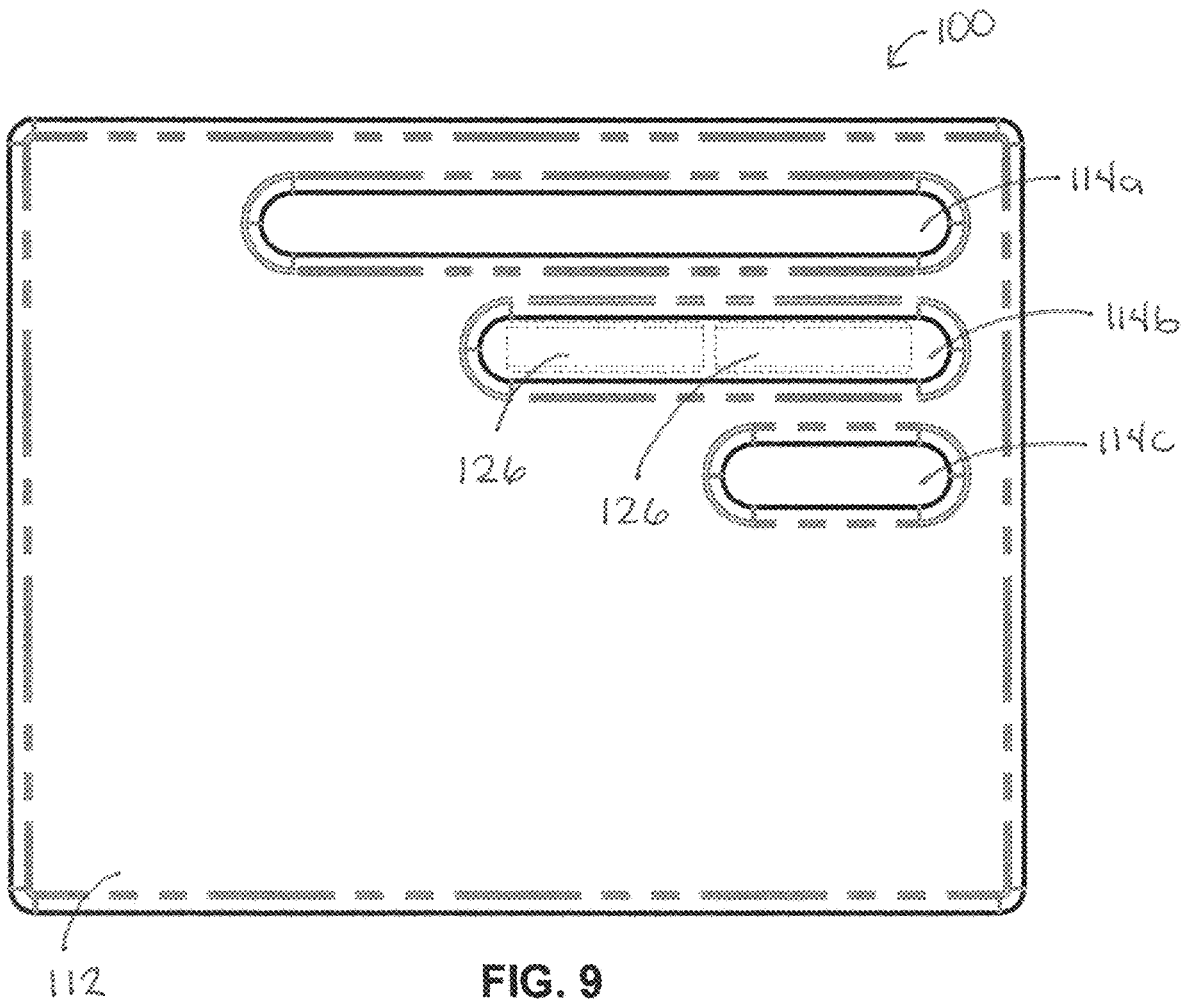
FIG. 9 is a side view of the toy of FIG. 1 including two rings.

FIGS. 7, 8, and 9, show the toy 100 being used in combination with the rings 126. During play, the user can insert the rings 126 into any of the first, second, and third openings 106*a*, 106*b*, 106*c*. For example, FIG. 7 shows a first ring 126*a* on the chute 124, a second ring 126*b* on the third internal horizontal shelf 104*c*, and a third ring 126*c* on the first internal horizontal shelf 104*a*. The fourth ring 126*d* is not shown in FIG. 7. To arrive at this arrangement rings, the user may first insert the first ring 126*a* into the third opening 106*a* and onto the third internal horizontal shelf 104*c*. Next, the user may push the first ring 126*a* off of the third internal horizontal shelf 104*c* by inserting the second ring 126*b* into the third opening 106*a* and onto the third internal horizontal shelf 104*c*, thereby causing it to slide on the chute 124 and arrive at the retrieval opening 108. Still referring to the arrangement of rings 126 in FIG. 7, the user may further start moving the rings onto the first internal horizontal shelf 104*a*. For example, FIG. 7 shows the third ring 126*c* resting on the first internal horizontal shelf 104*a*.

FIG. 8 shows another example arrangement of the rings 126 and the toy 100 during use or play. In this partial, side cross-sectional view, the rings 126 are shown to be aligned contiguously on the first internal horizontal shelf 104*a*. During play, the user may further use a fourth ring to push the first ring off of the distal end 134 of the first internal horizontal shelf 104*a* and onto the chute 124. The first, second, and third openings 106*a*, 106*b*, 106*c* are sized to receive one ring 126 at a time. The height of the ring 126 is at least about 50% of the height of the first, second, and third openings 106*a*, 106*b*, 106*c* at the front end 110 of the box. Similarly, the rear opening 122 is sized to receive one ring 126 at a time. For example, the height of the ring 126 is at least about 50% of the height of the rear opening.

FIG. 9 shows yet another example arrangement of the rings 126 and the toy 100 during use or play. In this arrangement, two rings 126 are resting on the second internal horizontal shelf (not shown in this view). The user can observe the movement of the rings 126 via the first, second, and third windows 114*a*, 114*b*, 114*c*. In this example, the user may be able to observe the rings through the second window 114*b* when viewing the toy 100 from a side angle or side view. The ability of the child (e.g., infant and/or toddler) to observe movement of the rings and visually confirm the number of rings that have been inserted, for example, can advantageously extend engagement of the child with the toy 100 during play and further facilitate development of any the afore-mentioned skills (e.g., cause-and-effect thinking skills, fine motor skills, and the like).

Figure 10:
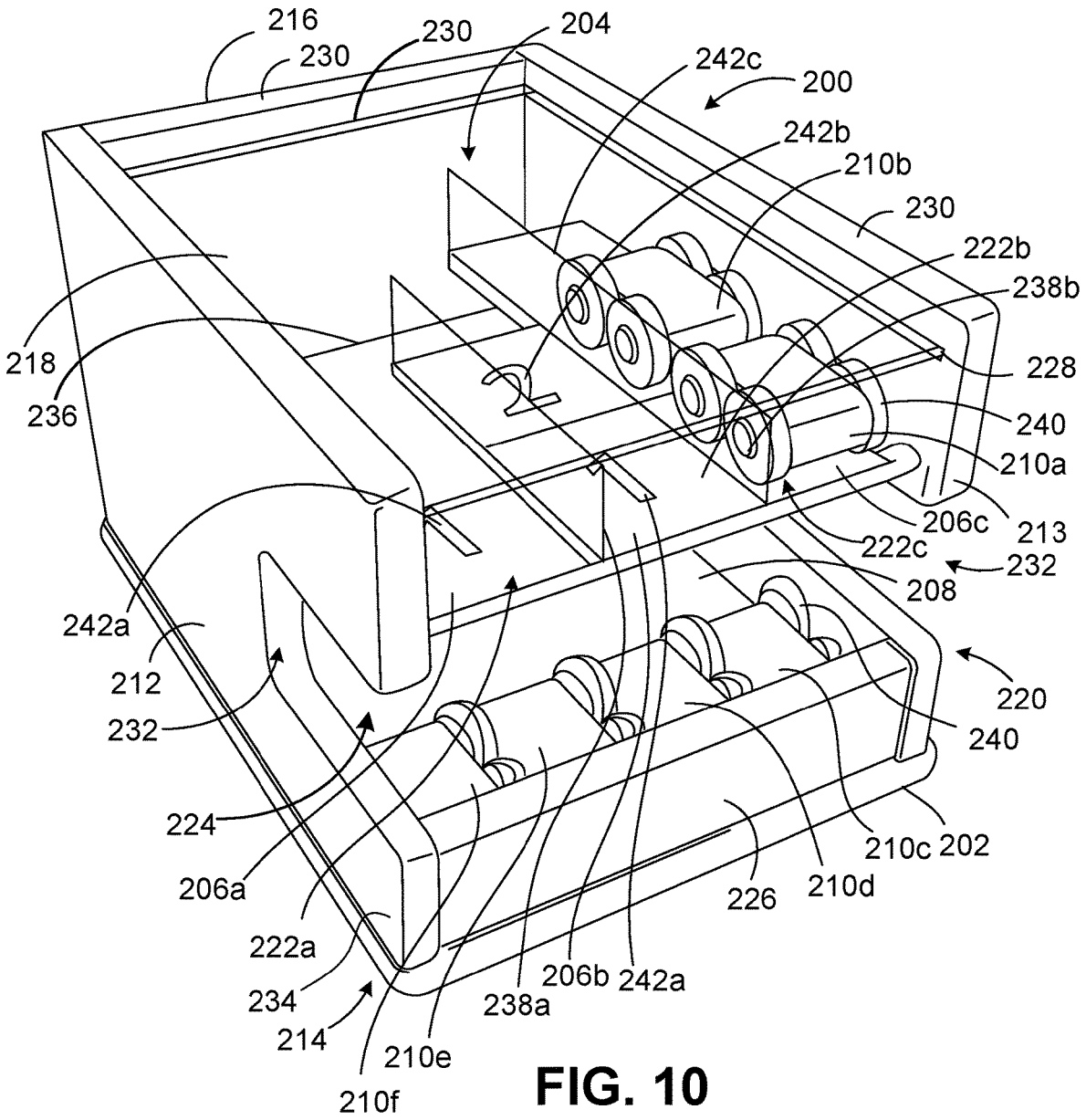
FIG. 10 is a perspective view of a toy including wheeled blocks.

FIG. 10 shows a toy 200 that can be used by a toddler and/or infant (e.g., under three years of age) for play and/or educational purposes. The toy 200 is typically made of one or more rigid materials that can withstand foreseeable use and/or damage by children. Example materials from which the toy 200 may be made include wood (e.g., birch plywood). The toy 200 includes a box 202 and a first, second, third, fourth, fifth, and sixth wheeled blocks 210*a*, 210*b*, 210*c*, 210*d*, 210*e*, 210*f*.

The box 202 includes a pair of side walls 212, 213 that are integrally connected with a bottom wall 214, a rear wall 216, and a front wall 226. The side walls 212, 213 and the rear wall 216 receive a panel 218 that together with the side walls 212, 213 form a substantially rectangular prism shape. The side walls 212, 213 and the rear wall 216 define slots 228 near upper portions 230. The slots 228 are configured to receive the panel 218 and secure it in place. The panel 218 is typically made of a transparent material (e.g., a transparent plastic) and allows a user to observe the one or more objects as they may be placed and/or pushed along on the first, second, and/or third internal horizontal shelves 206*a*, 206*b*, 206*c* and as they may be slid down the chute 208. The front wall 226 has height that is smaller than a height of the side walls 212, 213 and the rear wall 216. For example, the front wall 226 can have a height that is about a third of the height of the side walls 212, 213 and the rear wall 216. The height of the front wall 226 facilitates retaining the one or more objects at a retrieval opening 224 after they slide down the chute 208 while still allowing the user access to the objects. Each of the side walls 212, 213 define cutouts 232 near front portions 234 of the side walls 212, 213. The cutouts are C-shaped and can provide a user access to the retrieval opening 224 and the chute 208.

The box 202 defines an interior space 204 that includes a first internal horizontal shelf 206*a*, a second internal horizontal shelf 206*b*, a third internal horizontal shelf 206*c*, and a chute 208. The box 202 is open-ended and has a front end 220 that is open. The front end 220 can provide a user access to the interior space 204 of the box 202. The first, second, and third internal horizontal shelves 206*a*, 206*b*, 206*c* have different lengths and extend from a first, second, and third openings 222*a*, 222*b*, 222*c*, respectively, at the front end 220 to different depths within the interior space 204 of the box 202. For example, the first internal horizontal shelf 206*a* extends from the first opening 222*a* to a first depth of the box 202. The second internal horizontal shelf 206*b* extends from the second opening 222*b* to a second depth of the box 202. The third internal horizontal shelf 206*c* extends from the third opening 222*c* to a third depth of the box 202. The first, second, and third openings 222*a*, 222*b*, 222*c* are defined by first and second dividers 238*a*, 238*b* that are secured to and extend from a top surface of the shelves to a bottom surface of the panel 218. The first and second dividers 238*a*, 238*b* are typically made of a transparent material (e.g., a transparent plastic) and allow a user to observe the one or more objects when they are within the interior space 204 of the box 202. The first and second dividers 238*a*, 238*b* can be made of the same material that the panel 218 is made out of.

The first internal horizontal shelf 206*a* has a first length that is less than the lengths of the second internal horizontal shelf 206*b* and the third internal horizontal shelf 206*c*. The second internal horizontal shelf 206*b* has a second length that is less than the length of the third internal horizontal shelf 206*c* and that is greater than the first internal horizontal shelf 206*a*. The third internal horizontal shelf 206*c* has a third length that is greater than the length of the first and second internal horizontal shelves 206*a*, 206*b*. Similarly, the first internal horizontal shelf 206*a* extends to a first depth, within the interior space 204 of the box 202, that is greater than the second and third depths. The second internal horizontal shelf 206*b* extends to a second depth that is greater than the first depth and less than the third depth. The third internal horizontal shelf 206*c* extends to a third depth that is greater than the first and second depths.

The first, second, and third internal horizontal shelves 206*a*, 206*b*, 206*c* typically have equivalent widths that are about a third of the width of the box 202. The first, second, and third internal horizontal shelves 206*a*, 206*b*, 206*c* typically have a width that is greater than a width of an object (e.g., a wheeled block) configured to be inserted through the first, second, and/or third openings 206*a*, 206*b*, 206*c*. The first, second, and third internal horizontal shelves 206*a*, 206*b*, 206*c* typically have a width that is less than a width of two contiguous objects (e.g., two wheeled blocks), configured to be used inserted through the first, second, and/or third openings 206*a*, 206*b*, 206*c*.

The first, second, and third internal horizontal shelves 206*a*, 206*b*, 206*c* are arranged such that the first internal horizontal shelf 206*a* is positioned adjacent to the side wall 212 and the second internal horizontal shelf 206*b*, the second internal horizontal shelf 206*b* is adjacent to the first and third internal horizontal shelves 206*a*, 206*c*, and the third internal horizontal shelf 206*c* is adjacent to the side wall 213 and to the internal horizontal shelf 206*b*. In this manner, the underside of the first, second, and third internal horizontal shelves 206*a*, 206*b*, 206*c*, the side walls 212, 213, and the front wall 226 define the retrieval opening 224 that provides a user access to retrieve one or more objects that may be slid on the chute. The first, second, and third openings 222*a*, 222*b*, 222*c* are sized to receive one or more objects to be slid on the chute 208.

The first, second, and third internal horizontal shelves 206*a*, 206*b*, 206*c* are secured to the side walls 212, 213 of the box 202 and are arranged in a decreasing order according to their length. In some embodiments, the first, second, and third internal horizontal shelves 206*a*, 206*b*, 206*c* can be secured to the side walls via an adhesive (e.g., polyvinyl acetate (PVA) adhesive, polyurethane adhesive, or the like) or a fastener (e.g., a screw). In another example, the side walls 112, 113 can define slots configured to receive the first, second, and third internal horizontal shelves 206*a*, 206*b*, 206*c*.

The chute 208 has a planar surface that extends and slopes downwardly from a first end 236 to the front wall 226. The one or more objects (e.g., wheeled blocks) can fall in response to an additional object being pushed onto the shelf holding the objects after being inserted through the first, second, and/or third openings 222*a*, 222*b*, 222*c*. Once the object falls from the first end 236, it lands on an inclined surface or inclined plane of the chute 208 and rolls to the retrieval opening 224 at the front end 220 of the box 202. The inclined surface of the chute 208 can have a surface roughness that facilitates the sliding of one or more objects (e.g., by reducing or minimizing the resistance that the objects encounters when moving over the inclined surface). The chute 208 is typically made of one or more rigid materials that can have a substantially smooth surface on which the one or more objects (e.g., wheeled blocks) can slide on. Example materials from which the chute 208 may be made include wood (e.g., birch plywood).

As previously mentioned, the toy 200 includes first, second, third, fourth, fifth, and sixth wheeled blocks 210*a*, 210*b*, 210*c*, 210*d*, 210*e*, 210*f* that are configured to slide on the chute 208. The first, second, third, fourth, fifth, and sixth wheeled blocks 210*a*, 210*b*, 210*c*, 210*d*, 210*e*, 210*f* have a substantially rectangular shape and include four wheels 240. The wheels 240 can be secured to the wheeled blocks by rotatably mounting the wheels 240 to axles that traverse the wheeled blocks such that the wheels 240 rotate freely on the axles. A pair of wheels 240 are attached to each side of the wheeled blocks. The wheels 240 can facilitate the rolling and/or sliding of the wheeled blocks on the internal horizontal shelves and the chute. The first, second, third, fourth, fifth, and sixth wheeled blocks 210*a*, 210*b*, 210*c*, 210*d*, 210*e*, 210*f* are sized to be received by the first, second, and/or third openings 222*a*, 222*b*, 222*c*, the first, second, and third internal horizontal shelves 206*a*, 206*b*, 206*c*, and/or the chute 208.

The first, second, third, fourth, fifth, and sixth wheeled blocks 210*a*, 210*b*, 210*c*, 210*d*, 210*e*, 210*f* are typically made of one or more rigid materials that can withstand foreseeable use and/or damage by children. Example materials from which the wheeled blocks may be made include wood (e.g., birch plywood). The wheels 240 are typically made of one or more rigid materials that can withstand foreseeable use and/or damage by children. Example materials from which the wheeled blocks may be made include wood (e.g., birch plywood), rubber, plastic, or the like.

Each of the internal horizontal shelves is sized to fit and support a different number of wheeled blocks. For example, the first internal horizontal shelf 206*a* can hold one abutting wheeled block at most, the second internal horizontal shelf 206*b* can hold two abutting wheeled blocks at most, and the third internal horizontal shelf 206*c* can hold three abutting wheeled blocks at most. The first, second, third, fourth, fifth, and sixth wheeled blocks 210*a*, 210*b*, 210*c*, 210*d*, 210*e*, 210*f* typically have a width that is less than the width of the first, second, and third openings 222*a*, 222*b*, 222*c*.

Each of the first, second, and third internal horizontal shelves 206*a*, 206*b*, 206*c* include one or more markings that denote the number of wheeled blocks that can be supported by each shelf. For example, the first internal horizontal shelf 206*a* includes a first marking 242*a* denoting the number one, the second internal horizontal shelf 206*b* includes the first marking 242*a* and a second marking 242*b* denoting the number two, and the third internal horizontal shelf 206*c* includes the first and second markings 242*a*, 242*b* and a third marking 242*c* denoting the number three. The first, second, and third markings 242*a*, 242*b*, 242*c* can be manually or mechanically marked on a top surface of the first, second, and third internal horizontal shelves 206*a*, 206*b*, 206*c*. The first, second, and third markings 242*a*, 242*b*, 242*c* can be painted, etched, or printed on a top surface of the first, second, and third internal horizontal shelves 206*a*, 206*b*, 206*c*. For example, the first, second, and third markings 242*a*, 242*b*, 242*c* can be mechanically scribed (e.g., etched or printed) on a top surface of the first, second, and third internal horizontal shelves 206*a*, 206*b*, 206*c*. In another example, the first, second, and third markings 242*a*, 242*b*, 242*c* can be manually labeled (e.g., by using an adhesive label, ink, paint, or the like) on a top surface of the first, second, and third internal horizontal shelves 206*a*, 206*b*,

206*c*. The first, second, and third markings 242*a*, 242*b*, 242*c* may facilitate development of early math skills in children that use the toy 200 by providing both abstract representations of numbers (e.g., the markings) and concrete materials (e.g., the wheeled blocks).

During play, the user can insert one or more wheeled blocks into any of the first, second, and third openings 222*a*, 222*b*, 222*c*. For example, FIG. 10 shows the first and second wheeled blocks 210*a*, 210*b* on the third internal horizontal shelf 206*c*. The user may push the first and/or second wheeled blocks 210*a*, 210*b* off of the third internal horizontal shelf 206*c* by inserting the third wheeled block into the third opening 222*c* and onto the third internal horizontal shelf 206*c*, thereby causing it to slide on the chute 208 and arrive at the retrieval opening 224.

While the above-discussed toy 100 has been described and illustrated as with respect to certain dimensions, shapes, arrangements, configurations, and material formulations, and with respect to certain methods, in some embodiments, a toy that is otherwise substantially similar in construction and function to the toy 100, or to any of the above-discussed boxes, shelves, or chutes, may include one or more dimensions, shapes, arrangements, configurations, and/or materials formulations that are different from the ones discussed above or may be used with respect to methods that are modified as compared to the methods described above. For example, while the toy 100 has been described and illustrated as including a box 102 with a substantially rectangular shape, in some embodiments, a box that is otherwise substantially similar in construction and function to the box 102 may alternatively include a container that has a substantially cuboidal shape (e.g., with a square cross-sectional shape) or a substantially triangular prism shape (e.g., with a triangle cross-sectional shape).

While the toy 100 has been described and illustrated as including the first, second, and/or third internal horizontal shelves 104*a*, 104*b*, 104*c*, in some embodiments, a toy that is otherwise substantially similar in construction and function to the toy 100 may include one or more shelves (e.g., 1, 2, 3, 4, or more shelves).

While the toy 100 has been described and illustrated as including a chute 124 with a distal end 138 that is secured to the back wall 120 at an attachment point that is aligned with the second opening 106*b*, in some embodiments, a toy that is otherwise substantially similar in construction and function to the toy 100 may include a chute 124 with a distal end 138 that is secured to the back wall 120 at an attachment point that is aligned with the first opening 106*a* or with the third opening 106*c*.

While the toy 100 has been described and illustrated as including first, second, and third windows 114*a*, 114*b*, 114*c* shaped as rounded rectangles, in some embodiments, a toy that is otherwise substantially similar in construction and function to the toy 100 may include first, second, and third windows of a suitable shape other than a rounded rectangle (e.g., a rectangular shape, a circular shape, or the like).

While the toy 100 has been described and illustrated as including first, second, and third windows 114*a*, 114*b*, 114*c*, in some embodiments, a toy that is otherwise substantially similar in construction and function to the toy 100 may include one or more windows (e.g., 1, 2, 3, 4, or more).

While the toy 100 has been described and illustrated as including first, second, and third windows 114*a*, 114*b*, 114*c* having a length that is about equal to a length of the first, second, and/or third internal horizontal shelves 104*a*, 104*b*, 104*c*, respectively, in some embodiments, a toy that is otherwise substantially similar in construction and function to the toy 100 may include first, second, and third windows having a length that is less than or greater than the length of the first, second, and/or third internal horizontal shelves 104*a*, 104*b*, 104*c*.

While the toy 100 has been described and illustrated as including one or more rings 126, in some embodiments, a toy that is otherwise substantially similar in construction and function to the toy 100 may include one or more objects (e.g., disks or blocks) configured to be inserted through any of the openings of the toy and configured to be slid on the chute.

While the above-discussed toy 200 has been described and illustrated as with respect to certain dimensions, shapes, arrangements, configurations, and material formulations, and with respect to certain methods, in some embodiments, a toy that is otherwise substantially similar in construction and function to the toy 200, or to any of the above-discussed boxes, shelves, or chutes, may include one or more dimensions, shapes, arrangements, configurations, and/or materials formulations that are different from the ones discussed above or may be used with respect to methods that are modified as compared to the methods described above. For example, while the toy 200 has been described and illustrated as including a box 202 with a substantially rectangular shape, in some embodiments, a box that is otherwise substantially similar in construction and function to the box 202 may alternatively include a container that has a substantially cuboidal shape (e.g., with a square cross-sectional shape) or a substantially triangular prism shape (e.g., with a triangle cross-sectional shape).

While the toy 200 has been described and illustrated as including a panel 218 that is secured to the box 202, in some embodiments, a toy that is otherwise substantially similar in construction and function to the toy 200 may include a panel that is removably attached to the box 202.

While the toy 200 has been described and illustrated as including a panel 218 that is typically made of a transparent material, in some embodiments, a toy that is otherwise substantially similar in construction and function to the toy 200 may include a panel that is made of an opaque material (e.g., wood) and may include one or more windows defined by one or more side, bottom, or rear walls.

While the toy 200 has been described and illustrated as including a first, second, third, fourth, fifth, and sixth wheeled blocks 210*a*, 210*b*, 210*c*, 210*d*, 210*e*, 210*f*, in some embodiments, a toy that is otherwise substantially similar in construction and function to the toy 200 may include six or less wheeled blocks (e.g., 1, 2, 3, 4, or 5 wheeled blocks) or six or less wheeled blocks (e.g., 7, 8, 9, 10, or more).

While the toy 200 has been described and illustrated as including a first, second, third, fourth, fifth, and sixth wheeled blocks 210*a*, 210*b*, 210*c*, 210*d*, 210*e*, 210*f* that include wheels 240, in some embodiments, a toy that is otherwise substantially similar in construction and function to the toy 200 may blocks or other objects (e.g., other toys) that do not include wheels but are configured to be slid on the chute.

While a number of examples have been described for illustration purposes, the foregoing description is not intended to limit the scope of the invention, which is defined by the scope of the appended claims. There are and will be other examples and modifications within the scope of the following claims.

What is claimed is:

1. A toddler toy comprising:

a box comprising a first internal horizontal shelf and a second internal horizontal shelf extending to different depths from corresponding openings at a front end of the box; and a chute positioned below the first and second internal horizontal shelves, the chute configured to return one or more objects falling from distal ends of the shelves, in response to an additional object pushed onto one of the shelves through the corresponding opening, to a retrieval opening at the front end of the box, wherein a side wall of the box defines a first window and a second window, the first and second windows having a length that is equal to a corresponding length of each of the first and second internal horizontal shelves.

2. The toddler toy of claim 1, wherein a back wall of the box defines a rear opening sized to receive the one or more objects.

3. The toddler toy of claim 2, wherein the chute comprises a distal end coupled to the back wall, below the rear opening, and a proximal end at the front end of the box.

4. The toddler toy of claim 2, wherein the rear opening is directly aligned with a corresponding opening of the corresponding openings.

5. The toddler toy of claim 1, wherein the box comprises a third window.

6. The toddler toy of claim 5, wherein a window from the first, second, and third windows is a transparent panel.

7. The toddler toy of claim 5, wherein a window from the first, second, and third windows is aligned with a shelf from the first and second internal horizontal shelves.

8. The toddler toy of claim 1, wherein the one or more objects and the additional object comprise rings.

9. The toddler toy of claim 8, wherein the rings have a height that is at least 50% of a height of the openings at the front end of the box.

10. The toddler toy of claim 1, wherein the one or more objects and the additional object comprise blocks.

11. The toddler toy claim 10, wherein the one or more objects and the additional object are configured to slide on a surface of the chute.

12. The toddler toy of claim 10, wherein the one or more objects and the additional object comprise disks.

13. The toddler toy of claim 12, wherein the disks are wheels attached to the blocks.

14. The toddler toy claim 13, wherein the one or more objects and the additional object are configured to roll on a surface of the chute.

15. The toddler toy of claim 1, wherein the front end of the box is open.

16. The toddler toy of claim 1, wherein the chute has a curved surface.

17. The toddler toy of claim 1, wherein the chute has a planar surface.

18. The toddler toy of claim 1, wherein the chute extends downwardly towards the retrieval opening.

19. A toddler toy comprising:

a box comprising a first internal horizontal shelf, a second internal horizontal shelf, and a third internal horizontal shelf, the first, second, and third internal horizontal shelves extending to different depths from corresponding openings at a front end of the box; and a chute positioned below the first, second, and third internal horizontal shelves, the chute configured to return one or more objects falling from distal ends of the shelves, in response to an additional object pushed onto one of the shelf through the corresponding opening, to a retrieval opening at the front end of the box, wherein the chute has a curved surface extending downwardly towards the retrieval opening, and wherein a side wall of the box defines a first window, a second window, and a third window, the first, second, and third windows having a length that is equal to a corresponding length of each of the first, second, and third internal horizontal shelves.

* * * * *